US005867840A

United States Patent [19]

Hirosawa et al.

[11] Patent Number: 5,867,840

[45] Date of Patent: Feb. 9, 1999

[54] SAFETY HELMET AND A HEAD PROTECTOR THEREFOR

[75] Inventors: Hideaki Hirosawa, Tokyo; Sakae Fujihira, Ibaraki-ken, both of Japan

[73] Assignee: Shoei Kako Co., Ltd., Tokyo, Japan

[21] Appl. No.: 739,822

[22] Filed: Oct. 30, 1996

[30] Foreign Application Priority Data

Oct. 30, 1995 [JP] Japan ..... 7-282222

[51] Int. Cl.[6] ..... A42B 3/02

[52] U.S. Cl. ..... 2/414; 2/425

[58] Field of Search ..... 2/414, 411–413, 2/424, 425, DIG. 1, 171.3

[56] References Cited

U.S. PATENT DOCUMENTS

| | | | |
|---|---|---|---|
| 3,783,450 | 1/1974 | O'Connor | 2/425 |
| 4,054,953 | 10/1977 | De Barsy | 2/425 |
| 4,434,514 | 3/1984 | Sundahl et al. | 2/425 |
| 4,704,746 | 11/1987 | Nava | 2/424 |
| 5,086,520 | 2/1992 | Arai | 2/424 |
| 5,309,576 | 5/1994 | Broersma | 2/425 |
| 5,345,614 | 9/1994 | Tanaka | 2/425 |

FOREIGN PATENT DOCUMENTS

| | | | |
|---|---|---|---|
| 571065 | 11/1993 | European Pat. Off. | 2/411 |

*Primary Examiner*—Gloria M. Hale
*Attorney, Agent, or Firm*—Parmelee & Bollinger LLP

[57] ABSTRACT

A head protector comprising an outer hard shell and an absorbing liner inside of the outer shell wherein the liner comprises a main liner member and an inner subsidiary liner member whose density is lower than that of the main liner member and with an inner recess in the inner surface of the main liner member and wherein the inner subsidiary liner member is fitted into the inner recess.

42 Claims, 7 Drawing Sheets

SAFETY HELMET AND A HEAD PROTECTOR THEREFOR

TECHNICAL FIELD

This invention relates to a head protector for a safety helmet, comprising an outer shell made of hard material and an impact-on-the-head absorbing liner arranged on the inside of the outer shell, and to a safely helmet which includes the above head protector.

BACKGROUND OF THE INVENTION

Well-known is a safety helmet, such as jet-type one, semi-jet-type one or full-face-type one, which includes a head protector (hereinafter described in this text only as "head covering"), which is used to protect the head of a man with a helmet on, such as a rider on a motor-bicycle ("rider" is hereinafter used to mean "a rider or other user"). The conventional jet-type, semi-jet-type, or full-face-type helmet has generally a head covering and a pair of right and left chin straps, which are secured on the inside of the head covering, and typically constituted as follows.

The head covering has a cut (in the case of the jet-type or semi-jet-type helmet) or an opening (in the case of the full-face-type helmet), which is formed in the front of a part between the forehead and the chin (that is, the face). The jet-type or the semi-jet-type helmet further has a visor, which is secured to the head covering adjacent to the upper edge of the recess. The full-face-type helmet further has a shield plate, which is secured to the head covering so as to be movable between a lower position, where it closes the opening, and a upper position, where it opens the opening. The shield plate can be used for the jet-type helmet and the semi-jet-type helmet, for example in lieu of the visor. In that event, the shield plate can open and close the recess.

The head covering comprises an outer shell, which forms the outer peripheral wall of the head covering; a rim member; and a backing member, which is brought into contact with the inner surface of the outer shell and fixed by adhesive or so. The rim member is fixed to the rim of the outer shell by adhesive so that all the rim of the outer shell (in the case of the full-face-type helmet, all the rim of the opening is also included) is put between the rim member. The backing member includes a backing member for the head, which is to face the sinciput, the vertex, the temples and the occiput. The backing member of the jet-type or the semi-jet-type helmet further includes two backing members for the two ears, each of which is to face the ears, or the backing member for the head is integral with backing members for the ears. The backing member of the full-face-type helmet further includes a backing member for the chin, which is to face to the chin.

The backing member for the head comprises an impact-on-the-head absorbing liner and an air permeable back cover. The back cover for the head is secured to the impact absorbing liner by an adhesive or a tape so that the back cover for the head covers the inner surface of the impact absorbing liner (sometimes, an area to face the vertex of the rider or the like's head is partially excluded), the side surface (that is, a narrow surface lying between the inner surface and the outer surface), and the periphery of the outer surface which extends from the side surface. The impact absorbing liner is made of foamed synthetic resin, such as polystylene, polypropylene or polyethylene. The backing member for the jaw also has substantially the same structure as that of the backing member for the head except for having such a shape as to correspond to the rider's jaw. If necessary, a pair of right and left block-like inner pads is attached to a part of the inner surface of the impact-on-the-jaw absorbing liner (for example, two areas that face the rider's cheeks). Thus, this block-like inner pad is positioned between the impact-on-the-jaw absorbing liner and the back cover for the jaw. The backing member for each ear also has substantially the same structure as that of the backing member for the head or jaw except for having such a shape as to correspond to the rider's ear.

When impact is exerted on a part of the outer shell of the conventional safety helmet typically constituted as above, the impact is widely dispersed throughout the outer shell and the impact energy is absorbed by the deformed outer shell. Further, the impact absorbing liner functions in absorbing the impact energy propagated from the outer shell by means of its deformation, absorbing the impact energy by means of its thickness reduction (that is, compressive deformation), and lowering the maximum acceleration due to the impact by means of delaying the propagation of this impact energy exerted on the rider's head. In this text, the "maximum acceleration" means the maximum value of the acceleration through an impact absorbing test for the helmet.

Up to nowadays, the above impact absorbing test has been made to ascertain the protective characteristic of the safety helmet. In this impact absorbing test, a metallic head model imitating the head of a man with a helmet on is used, in which an accelerometer is incorporated. A standard on the maximum acceleration measured with the accelerometer has been adopted in each country. Further, an index of HIC (Head Injury Criteria) has been proposed on the basis of correlation between the mean acceleration value of a certain duration and the duration of the appearances of values continuously over this mean acceleration value, and the brain damage. HIC is given by:

$$HIC = \left( \frac{1}{t2 - t1} \times \int_{t1}^{t2} a(t)dt \right)^{2.5} \times (t2 - t1)$$

where a(t) is the change of acceleration value with time during the impact absorbing test, and $t_1$, $t_2$ are the time, each maximizing the HIC value.

The HIC value has been considered to have good correlation with the level of the injuries suffered in an accident. According to Mr. P. D. Hope of Transport and Road Research Laboratory established in England, in an accident on the motor-bicycle, when the HIC value is 1,000, the probability of mortality is 8.5%; when the HIC value is 2,000, the probability of mortality is 31%; and the HIC value is 4,000, the probability of mortality is 65%. Therefore, it is necessary to lower the HIC value in order to lower the level of the injuries.

As described above, it is necessary to lower the maximum acceleration value and the HIC value due to the impact, if it is desired to improve the protective characteristic of the safety helmet. Such being the case, in order to lower the maximum acceleration value and the HIC value, the thickness of the impact absorbing liner has been increased so far.

However, only to increase the thickness of the impact absorbing liner is insufficient for the reduction of the maximum acceleration value and, particularly, difficult for the reduction of the HIC value. The HIC value includes the duration of the appearances of values continuously over a specific acceleration value, so that even if the maximum acceleration value is a little lowered due to a cushion characteristic of the impact absorbing liner, it is impossible to shorten the duration of the appearances of values continuously over the specific acceleration value. Thus, it is impossible to reduce the HIC value.

SUMMARY OF THE INVENTION

Accordingly, it is a main object of the present invention to provide a head covering for a safety helmet in which both maximum acceleration values and HIC values caused by an impact are effectively lowered without reducing particularly the rigidity of an impact-on-the-head absorbing liner.

It is another object of this invention to provide a head protector for a safety helmet, which has good ventilation.

In accordance with one aspect of this invention, in a head protector for a safety helmet, comprising an outer shell made of hard material and an impact-on-the-head absorbing liner arranged on the inside of the outer shell; the impact absorbing liner comprises a main liner member and an inner subsidiary liner member, whose density is lower than that of the main liner member, and provided in the inner surface of the main liner member is an inner recess, into which the inner subsidiary liner member is fitted. In that event, it is desirable that the respective inner recess and inner subsidiary liner member are provided only substantially in the inner surface of the top portion of the impact absorbing liner and each of them is of substantially elliptical, substantially elongated circular or substantially circular shape.

In accordance with another aspect of this invention, in a head protector for a safety helmet, in which the inner recess and the inner subsidiary liner member are provided, the impact absorbing liner further comprises an outer subsidiary liner member, whose density lies between the densities of the main liner member and the inner subsidiary liner member, and provided in the outer surface of the main liner member is an outer recess, into which the outer subsidiary liner member is fitted. In that event, it is desirable that at least one vent hole is formed between the main liner member and the outer subsidiary member. Further, it is desirable that the respective outer recess and outer subsidiary liner member are disposed from the front portion to the rear portion through the top portion of the outer surface of the impact absorbing liner but not disposed substantially in the right and left portions thereof and that, when developed, they are of substantially rectangular, substantially elliptical or substantially elongated circular shape.

The above, and other, objects, features and advantages of the present invention, will become readily apparent from the following detailed description thereof which is to be read in connection with the accompanying drawings.

DETAILED DESCRIPTION OF THE INVENTION

Figure 1:
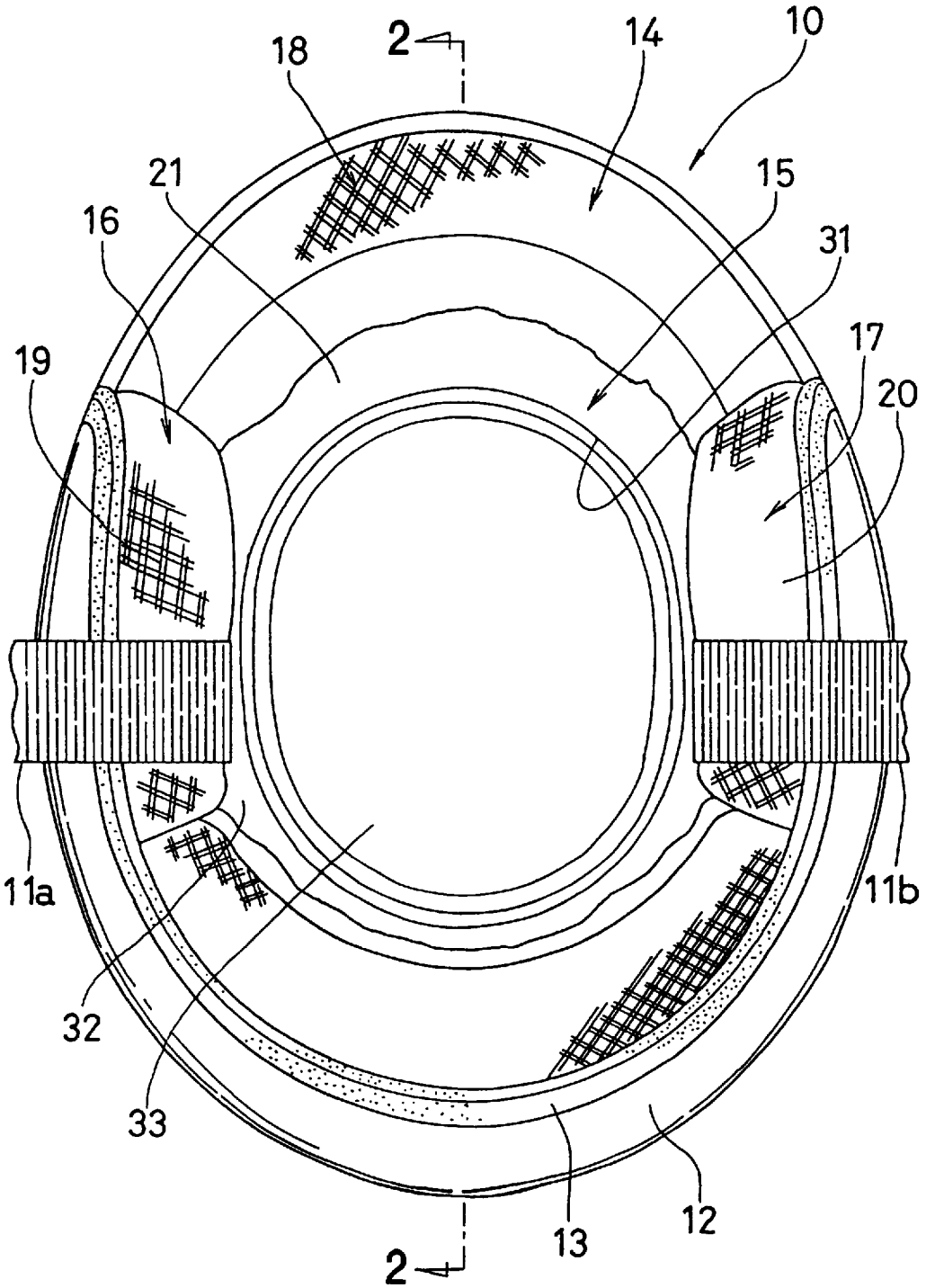
FIG. 1 is a bottom view of a head covering according to one embodiment of this invention, the back cover thereof being partly broken away and both base portions of a pair of right and left chin straps being added.
Figure 2:
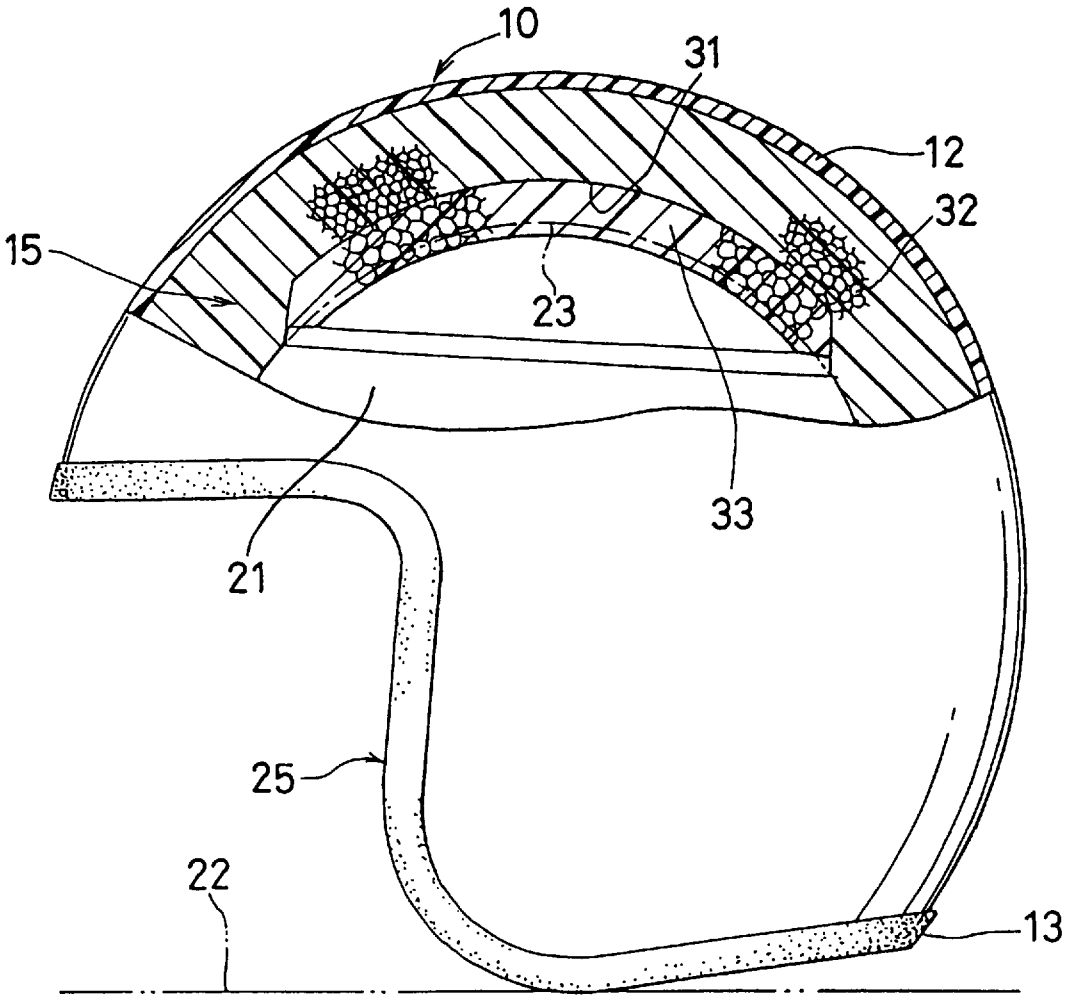
FIG. 2 is a right side view, partly in section, of the head covering shown in FIG. 1, the back cover thereof being omitted and the upper portion thereof being shown by a longitudinal sectional view taken along with the line A—A on FIG. 1.
Figure 3:
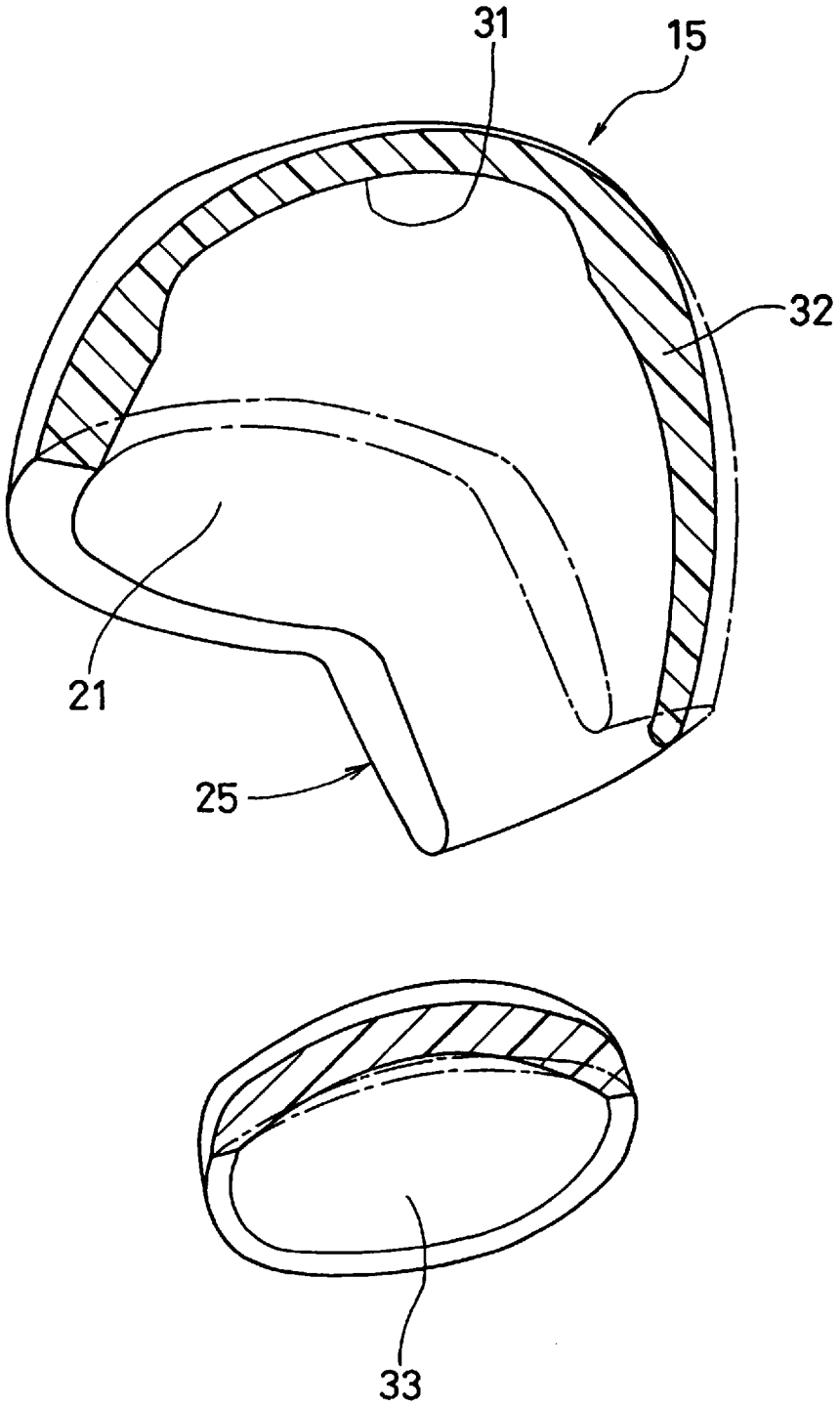
FIG. 3 is an exploded, perspective view, in section, of the head covering shown in FIG. 1.

Firstly, a head covering shown in FIGS. 1–4 according to a first embodiment of this invention will be hereinafter described. As shown in FIGS. 1 and 2, this head covering 10 is used for making up a jet-type safety helmet, so that this helmet has not only the head covering 10 but also a pair of right and left well-known chin straps 11*a,* 11*b,* the base ends of which are secured on the inside of the head covering 10, respectively. The helmet may also have a well-known visor or a well-known shield plate (not shown). Shown in FIG. 2 is the head covering just at the time when a rider or the like with the helmet on is in an ordinary stance (in this text, described hereinafter as "the head covering worn in the ordinary stance").

As shown in FIGS. 1 and 2, the head covering 10 comprises a domelike outer shell 12 forming the outer peripheral wall thereof; the hereinbefore described well-known rim member 13; a backing member 14 for the head fixed on the inside of the outer shell 12 by adhesive or the like; and backing members 16, 17 for the right ear and the left ear.

The feature of this invention is in the structure of an impact-on-the-head absorbing liner 15, and the other structures may be the same as those used in the hereinbefore described well-known helmet, so that the description of the other structures will not be given except when necessary.

When an impact is exerted on a part of the outer shell 12, the impact must be widely dispersed throughout the outer shell and the impact energy must be absorbed due to the deformation of the outer shell 12, so that the outer shell 12 should have high rigidity and high breaking strength. Thus, the outer shell 12 may be made from strengthened rigid resin obtained by curing a mixture of reinforcing material, such as glass fiber, carbon fiber, high strength organic fiber or the like, and thermoset resin, such as unsaturated polyester resin, epoxy resin or the like. The outer shell 12 may also be made from strengthened rigid resin obtained by hot forming of a mixture of the above reinforcing material and thermoplastic resin, such as polycarbonate or the like. Further, the outer shell 12 may also be made from composite material obtained by backing those rigid resins with a soft sheet like an unwoven fabric sheet.

It is preferable that the thickness of the outer shell is 1–6 mm and it is much preferable that the thickness is 2–5 mm. It is not desirable that the thickness is outside the above range. That is, the smaller the thickness is, the lower the rigidity of the outer shell 12 is, and the larger the thickness is, the heavier the outer shell 12 is.

The backing member 14 for the head may have a shape abutting substantially on the whole of the inner surface of the outer shell 12 but, in the first embodiment, the backing member 16 for the right ear and the backing member 17 for the left ear may be formed separately therefrom as shown in FIG. 1. In the case of the latter, the backing member 14 for the head has such a shape as to have cut portions, which face the inner surface of the outer shell 12 and face each of the rider's right and left ears.

The backing member 14 for the head shown in FIG. 1 comprises an impact-on-the-head absorbing liner 15, which has such a shape as to have cut portions, which face the inner surface of the outer shell 12 and yet face each of the rider's right and left ears, and an air permeable back cover 18 for the head, which covers the inner surface of the liner 15. In FIGS. 1 and 2, this back cover 18 for the head is cut off and omitted in the range corresponding to the top portion of the liner 15, which is to face the rider's vertex.

The backing member 16 for the right ear and the backing member 17 for the left ear comprise an impact absorbing liner for the right ear and an impact absorbing liner for the left ear (both are not shown); a block-like inner pad for the right ear and a block-like inner pad for the left ear (both are not shown) provided on the inner surfaces of the respective impact absorbing liners, and made of flexible elastic material like urethane foam, other synthetic resin or the like; and an air permeable back cover 19 for the right ear and an air permeable back cover 20 for the left ear which cover not only those pads but also the respective impact absorbing liners for the right and left ears from the inner surface sides thereof. The pair of right and left chin straps 11*a,* 11*b* described hereinbefore are secured to the backing members 16, 17 for the right and left ears, respectively.

The impact-on-the-head absorbing liner 15 must be deformed to absorb the impact energy propagated from the outer shell 12, and must reduce its thickness to absorb the impact energy and to delay transmission of the impact energy to the rider's head, so that the liner 15 should have a suitable plastic deformation rate and a suitable elastic deformation rate.

The head covering 10 has five areas: a front portion to face the rider's sinciput, a top portion to face the rider's vertex, right and left side portions to face the rider's right and left temples, and a rear portion to face the rider's occiput, and the top portion of the liner 10 is substantially of hemispherical shape and connected to the front portion, the right and left portions and the rear portion, so that the strength of the top portion is highest among all the portions. In the case of different types of helmets: the jet-type, the semi-jet-type and the full-face-type helmets, the rear portion of the head covering 10 extends downwards and is connected to the top portion and both the right and left portions, so that it has the second strength among all. As stated before, the front portion of the head covering 10 has the cut 25 or the opening and, as the case may be, has a ventilation mechanism, so that its strength is lowest. Further, the right and left side portions of the head covering 10 are located adjacent to the cut 25 or the opening, so that its strength is higher than the front portion but considerably lower than the one of the rear portion.

As described above, the top portion of the conventional head covering 10 has the highest strength among all portions and is of hemispherical shape, so that it is not deformed effectively due to the impact energy transmitted from the outer shell 12. Thus, when an impact test is made under the same condition, the maximum acceleration value and the HIC value of the top portion tends to be higher than the other portions (the front portion, the right and left portions and the rear portion). Therefore, to disperse the impact energy exerted on the head covering 10; to make it absorb effectively and, thereby, to reduce its maximum acceleration value and its HIC value, it is necessary that, in the top portion of the head covering 10, the impact absorbing liner 15 is deformed due to the impact so as to disperse the impact energy and make the liner 15 absorb it, and the thickness of the liner 15 is effectively reduced so as to enable the liner 15 to absorb effectively the impact energy.

Such being the case, as shown in FIGS. 1–4, the impact-on-the-head absorbing liner 15 disclosed in the first embodiment of this invention comprises:

(1) main liner member 32, in the inner surface of substantially the central portion (that is, substantially the top portion) of which is disposed a substantially elliptical or elongated recess 31, whose major axis substantially coincides with the longitudinal axis of the head covering 10, and (2) inner subsidiary liner member 33 fitted into the recess 31 so as to be secured to the main liner member.

It is requested that either of the main liner member 32 and the inner subsidiary liner member 33 have suitable plastic and elastic deformation rates, so that it is preferable that they are made of foamed plastics, such as polystylen foam, polypropylene foam, polyethylene foam or the like. Further, it is desirable that both these members 32, 33 are made of the same material, but they may be made of different materials. In these foamed plastics, generally the density (g/lit) is substantially proportional to the compression strength (kg/$cm^2$) and the bending strength (kg/$cm^2$), and the density influences the impact absorbing ability and the transmission ability.

In this invention, it is required that the compression strength and the bending strength of the inner subsidiary liner member 33 are lower in comparison with those of the main liner member 32, so that the density of the inner subsidiary liner member 33 is lower than that of the main liner member 32.

It is desirable that the respective configurations of the recess 31 and the inner subsidiary liner member 33 are substantially elliptical (including circular) or elongated and they are longer in the longitudinal or lateral direction, but they may be substantially polygonal, substantially star-like or suitably shaped. Further, it is desirable that the configuration of the inner subsidiary liner member 33 substantially coincides with that of the recess 31, or smaller than but similar to that of the recess 31. But it is not always necessary to be so. The inner subsidiary liner member 33 can be secured to the main liner member 33 by an adhesive or a tape, but it may be secured only by means of being fitted into the recess 31 of the main liner member 32 so as not to be easily separated.

It is preferable that the density of the main liner member 32 is generally within the range of 20–80 g/lit, and it is much preferable that the density is within the range of 30–70 g/lit. As the density is larger over the above range, the impact-on-the-outer-shell absorbing ability of the main liner member 32 becomes smaller, so that most of the impact energy is transmitted directly to the rider's head. As the result, the maximum acceleration of the head increases, so that the protection effect of the helmet becomes insufficient. On the contrary, as the density of the main liner member 32 is smaller below the above range, its impact absorbing ability becomes larger, so that the deformation of the main liner member 32 due to the impact becomes too large to prevent damage easily.

Particularly, if a colliding object is of spherical or dully protruding shape and, yet, the density of the main liner member 32 is too low, the impact energy transmitted from the outer shell 12 to a part of the main liner member 32 is not effectively dispersed widely in the main liner member 32 but exerted on its extremely limited area, so that the main liner member 32 is deformed and compressed (that is, its thickness decreases) within the extremely limited area. As the result, a so-called bottoming phenomenon occurs and a large force is exerted on the head. To prevent the bottoming phenomenon, it is necessary to increase the original thickness of the main liner member 32 (that is, the thickness of the main liner member 32 at the time when the recess 31 is not disposed and, instead thereof, there exists a part, in itself, of the main liner member 32 so that its inner surface 23 may be substantially of semispherical shape). However, as the thickness of the main liner member 32 increases, the head covering 10 is too large, so that it becomes difficult to wear the helmet, or the wind pressure on the helmet much increases. Thus, it is of little utility. Therefore, it is preferable that the original mean thickness of the main liner member 32 at the time when it is assumed that the recess 31 is not provided is within 15–55 mm and it is much preferable that the mean thickness is within 25–45 mm.

The recess 31 can be formed concurrently when the main liner member 32 is foam-molded in a mold, or it can be formed by machining after the foam molding of the main liner member 32.

The above description of the material and density of the main liner member 32 will be applicable to the impact absorbing liner for the right and left ears.

It is preferable that the density of the inner subsidiary liner member 33 is generally within the range of 20–80% of that of the main liner member 32. It is much preferable that it is within the range of 35–65%. Concretely speaking, it is preferable that the density of the inner subsidiary liner member 33 is within the range of 5–50 g/lit. It is much preferable that it is within the range of 10–40 g/lit. As the density of the inner subsidiary liner member 33 increases over the above range, the effect of providing the inner subsidiary liner member 33 becomes insufficient. On the contrary, as the density of the inner subsidiary liner member 33 decreases below the above range, its impact absorbing ability becomes poor, so that when the spherical or dully protruding object collides, the possibility of the early occurrence of the bottoming phenomenon increases.

Figure 4:
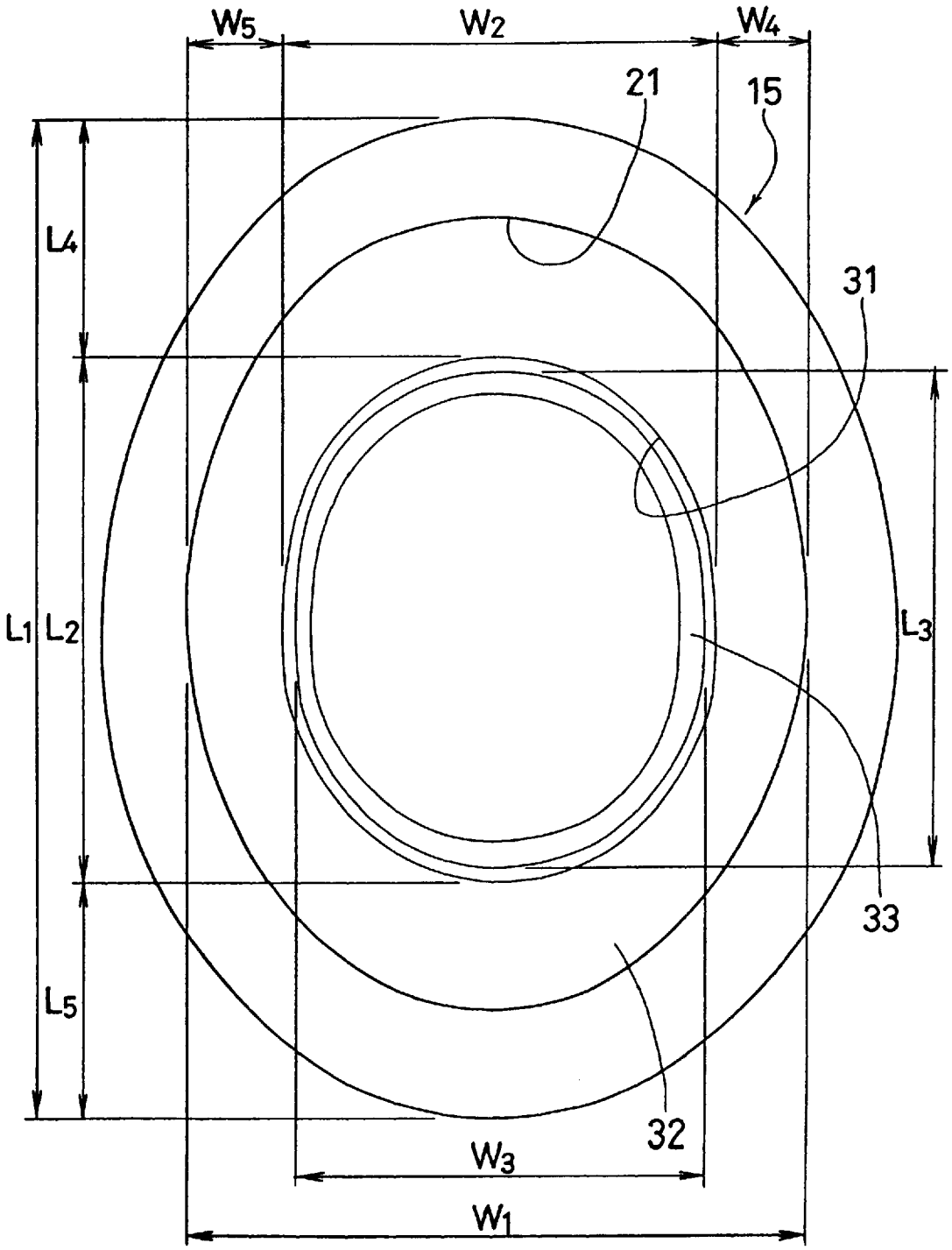
FIG. 4 is a projection representation, projected on the horizontal plane, of the bottom surface of the impact-on-the-head absorbing liner shown in FIGS. 1–3.

FIG. 4 is the projection representation of the bottom surface of the impact-on-the-head absorbing liner 15 at the time when the head covering 10 worn in the ordinary stance is projected on the horizontal plane 22. As shown in FIG. 4, the recess 31 and the inner subsidiary liner member 33 in the projection representation may be each substantially similar in shape to and that substantially concentric with the space 21, to be occupied by the head, of the liner 15 (in other words, the main liner member 32).

In the projection representation of FIG. 4, it is preferable that length $L_2$ along the longitudinal direction (vertical direction in FIG. 4) of the recess 31, and length $W_2$ along the lateral direction (horizontal direction in FIG. 4) thereof are 40–80% of the longitudinal length $L_1$ of the space 21 (that is $L_2/L_1$=0.4–0.8), and 45–85% of the lateral length $W_1$ of the space 21 (that is $W_2/W_1$=0.45–0.85). It is much preferable that $L_2$ and $W_2$ are 50–70% of $L_1$ (that is $L_2/L_1$=0.5–0.7) and 55–75% of $W_1$ (that is $W_2/W_1$=0.55–0.75). Thus, it becomes possible to provide the recess 31 in the head covering 10, so that the recess 31 may face substantially the rider's vertex. From the standpoint of its utility, it is preferable that the longitudinal length $L_1$ of the space 21 is 190–250 mm. It is much preferable that $L_1$ is 205–235 mm. Further, it is preferable that the lateral length $W_1$ of the space 21 is 150–210 mm. It is much preferable that $W_1$ is 165–195 mm. Thus, it is preferable that length $L_2$ is 80–200 mm. It is much preferable that $L_2$ is 100–160 mm. Further, it is preferable that length $W_2$ is 70–170 mm. It is much preferable that $W_2$ is 90–140 mm.

In the projection representation shown in FIG. 4, it is preferable that the longitudinal length $L_3$ and the lateral length $W_3$ of the inner subsidiary liner member 33 is within the range of 60–100% of the longitudinal length $L_2$ and the lateral length $W_2$ of the recess 31, respectively. It is much preferable that they are within the range of 75–100%, respectively. As the lengths $L_3$ and $W_3$ reduce below the above range, the effect of the inner subsidiary liner member 33 becomes insufficient.

As stated before, in the projection representation of FIG. 4, the figure of the recess 31 may be substantially similar in shape to the space 21 and substantially coaxial with the space 21. Therefore, length $L_4$ between the front end of the space 21 and the front end of the recess 31 may be substantially the same as length $L_5$ between the rear end of the space 21 and the rear end of the recess 31. Thus, it is preferable that the lengths $L_4$, $L_5$ are each 10–30% of the length $L_1$. It is much peferable that the lengths $L_4$, $L_5$ are each 15–25% thereof. Concretely speaking, it is preferable that they are 20–65 mm. It is much preferable that they are 30–55 mm.

Moreover, length $W_4$ between the left end (the right end in FIG. 4) of the space 21 and the left end of the recess 31 may be substantially the same as length $W_5$ between the right end of the space 21 and the right end of the recess 31. Therefore, it is preferable that the lengths $W_4$, $W_5$ are each 8–28% of the length $W_1$. It is much preferable that $W_4$, $W_5$ are each 13–23% thereof. Concretely speaking, it is preferable that $W_4$, $W_5$ are 15–55 mm in length. It is much preferable that they are 20–45 mm.

As a result of the foregoing, in the projection representation of FIG. 4, the recess 31 is inscribed in a substantially rectangular area having longitudinal length $L_2$ and lateral length $W_2$, so that the recess 31 is apart in lengths $L_4$ and $L_5$ from the front end and the rear end of the space 21 of the liner 15, respectively, and apart in lengths $W_4$ and $W_5$ from the right side end and the left side end thereof, respectively. Thus, the recess 31 is formed only substantially in the top portion of the inner surface of the liner 15 and not formed substantially in the front portion, the right and left side portions and the rear portion of the inner surface of the liner 15, so that the formation of the recess 31 does not worthlessly cause the reduction of the rigidity (that is, the strength) of the whole of the liner 15.

It is desirable that the depth of the recess 31 (in other words, the distance between the bottom surface of the recess 31 and the original inner surface 23 of the liner 15) is smaller than a half of the original thickness of the liner 15 (that is, the original thickness of the main liner member 32) and larger than 5 mm. It is preferable that the original thickness of the liner 15 is within 15–55 mm and it is much preferable that it is within 25–45 mm as stated before, so that it is preferable that the depth of the recess 31 is within 5–30 mm and it is much preferable that it is within 10–20 mm. As the depths of the recess 31 increase over the above range, the rigidity of the whole of the liner 15 reduces, so that when an impact is exerted on the liner 15, the dispersion of the impact energy is insufficient. Thus, the bottoming phenomenon comes to the liner 15 due to the impact caused by the collision of a spherical or dully peaked object with the helmet, so that the maximum acceleration value will probably rise rapidly. On the contrary, as the depths of the recess 31 decrease over the above range, the effect of providing the recess 31 becomes gradually insufficient.

The depth of the recess 31 may be substantially uniform throughout its area, or it may be different in each spot: for example, it may be deep only in its central portion and gradually shallow toward its outer periphery. The recess 31 shown in FIG. 2 is shallow only near its periphery and uniformly deep in the remaining portion.

It is preferable that the thickness of the inner subsidiary liner member 33 is substantially equal to the depth of the recess 31, or larger than the depth of the recess 31 within less than 10 mm in positive number. If the thickness of the inner subsidiary liner member 33 is denoted by T and the depth of the recess 31 is denoted by D, it is preferable that T is within the range of D–(D+10 mm) and it is much preferable that T is within the range of (D+3 mm)–(D+7 mm). As the thickness of the inner subsidiary liner member 33 increases over the above range, the amount of the portion of the inner subsidiary liner member 33, which projects like a plateau from the original inner surface of the main liner member 32, is larger, it becomes difficult to wear the head covering 10. On the contrary, as the thickness of the inner subsidiary liner member 33 decreases below the above range, the effect of the recess 31 and the inner subsidiary liner member 33 becomes insufficient.

The thickness of the inner subsidiary liner member 33 may be substantially uniform in whole, or may be thick or thin in part: for example, it may be thick only in its central portion and gradually becomes thin toward its periphery. In the inner subsidiary liner member 33 shown in FIG. 2, the thickness is thin only near the periphery and is uniformly thick in the remaining portion.

As described above, if the recess 31 is provided substantially in the top portion of the inner surface of the main liner member 32 and the inner subsidiary liner member 33, whose density is lower than that of the main liner member 32, is also provided, the liner 15 is easily deformed along the surface of the rider's vertex in a desirable direction owing to the inner subsidiary liner member 33 provided on the inside of the liner 15, when the impact is exerted on the head covering 10, so that the impact energy can be effectively dispersed throughout the top portion of the liner 15 so as to be absorbed in the liner 15 and, also, can be effectively absorbed in the compressively deformed liner 15. Therefore, it is possible to reduce effectively the maximum acceleration exerted on the rider's head and to decrease the duration of continuation of the acceleration values that exceeds a predetermined value and, thereby, lower the HIC value.

Moreover, the liner 15 according to the first embodiment attains a higher degree of freedom on its deformation in the any direction along the surface of the rider's, so that it is possible to form the main liner member 32 with higher density foam material as compared with the impact-on-the-head absorbing liner of the conventional head covering, in which recess 31 and the inner subsidiary liner member 33 are not provided. Accordingly, even if the thickness of the main liner member 32 decreases due to the formation of recess 31, it does not occur to weaken the whole of the liner 15 against the impact caused by the collision with the spherical or dully protruding object. Further, the recess 31 is provided only in the top portion having the highest strength in the main liner member 32, so that it does not occur that the strength of the whole of the liner 15 worthlessly decreases as compared with a liner having such recess also in its front portion and its right and left side portions, the strength of which is comparatively small.

Example of the head covering shown in FIGS. 1–4, according to the first embodiment of this invention, will be hereinafter described.

Example

A glass fiber impregnated with unsaturated polyester is heated to polymerize in a metal mold in order to form a outer shell 12 whose thickness is 3 mm.

Next, a main liner member 32 of formed polystyrene is formed, the mean thickness of which is 35 mm when it is assumed that it has the original inner surface 23, and whose density is 42 g/lit. In the projection representation shown in FIG. 4, the longitudinal length $L_1$ and the lateral length $W_1$ of the space 21 of this main liner member 32 are 220 mm and 180 mm, respectively. A recess 31 is provided substantially in the top portion of the inner surface of the main liner member 32, and the longitudinal length $L_2$ and the lateral length $W_2$ of the recess 31 are 126 mm ($L_2/L_1 \approx 0.57$) and 126 mm ($W_2/W_1 \approx 0.7$), respectively. $L_4$ and $L_3$ are both 47 mm and $W_4$ and $W_5$ are both 27 mm. The depth of the recess 31 is 10 mm: that is, it is about 29% of the mean original thickness of the main liner member 32.

An inner subsidiary liner member 33 of foamed polystylene is made, whose density is 21 g/lit (50% by density of the main liner member 32) and whose thickness is 15 mm. This inner subsidiary liner member 33 is of substantially circular shape, whose longitudinal length $L_3$ and lateral length $W_3$ are each 120 mm (about 95% of the respective longitudinal and lateral lengths $L_2$ and $W_2$ of the recess 31).

The inner subsidiary liner member 33 is fitted into the recess 31 of the inner surface of the main liner member 32 and, thus, an impact-on-the-head absorbing liner 15 is made, in which the inner subsidiary liner member 33 protrudes substantially like a plateau in height of about 5 mm from the inner surface 23, in itself, of the main liner member 32. Then, the impact-on-the-head absorbing liner 15 is fitted into the outer shell 12 to make a head protector.

A comparable example to be compared with the above Example will be hereinafter described.

Comparable Example

A head covering made under the same specifications as those disclosed in the Example is provided for the comparison, except that both the recess 31 and the inner subsidiary liner member 33 are not provided in the main liner member 32, so that the impact-on-the-head absorbing liner comprises only the main liner member, whose inner surface is of substantially spherical shape and substantially equal to the imaginary curved surface (that is, the original inner surface) 23.

Impact absorbing tests made for the head covering of the Example and Comparable Example will be hereinafter described.

Impact Absorbing Test

The head covering worn on a head dummy is made to freely fall down on a plane of steel from a height of 2.9 m, and the maximum acceleration, the period of duration of the acceleration over 150 G, and the HIC value thereof are calculated on the basis of the values measured by an accelerometer secured to the head dummy. G means gravitational acceleration and its value is 9.8 $m/s^2$.

The following table shows the result of the impact absorbing test in comparison between Example and Comparable Example.

| | Ex. | Comp. Ex. |
|---|---|---|
| Max Acc. (G) | 207 | 234 |
| P. of Duration of Val. over 150 G (msec) | 2.58 | 3.68 |
| HIC | 1477 | 2032 |

According to the table, it is apparent that the maximum acceleration and HIC of Example is lower than those of Comparable Example.

A head covering shown in FIGS. 5–7 according to the second embodiment of this invention will be hereinafter described. It is noted that the description of the first embodiment holds good with the second embodiment except for the different points between them, which will be described below.

The head covering according to the second embodiment of this invention (FIGS. 5–7) is only practically different from the head covering 10 according to the first embodiment (FIGS. 1–4) except the structure of the impact-on-the-head absorbing liner 15, which comprises the backing member for the head, and the provision of the ventilation mechanism, and the remaining structure may be substantially equal to that of the head covering shown in FIGS. 1–4. Thus, the explanation of the remaining structure will be omitted if unnecessary, and the same reference numbers will be used to identify the same elements.

Figure 5:
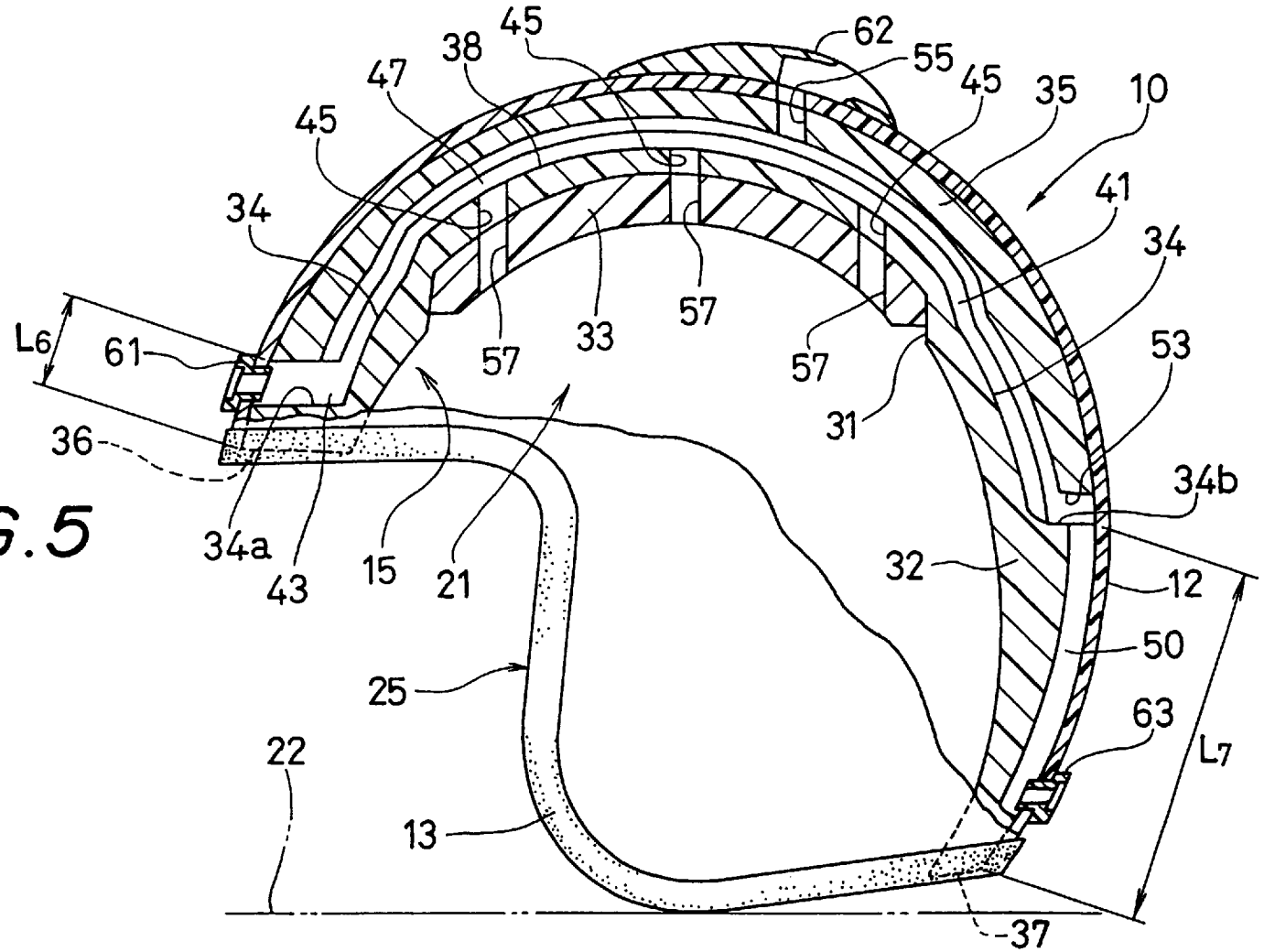
FIG. 5 is a right side view, partly broken away and partly in section along the vent hole, of a head covering according to another embodiment of this invention.
Figure 6:
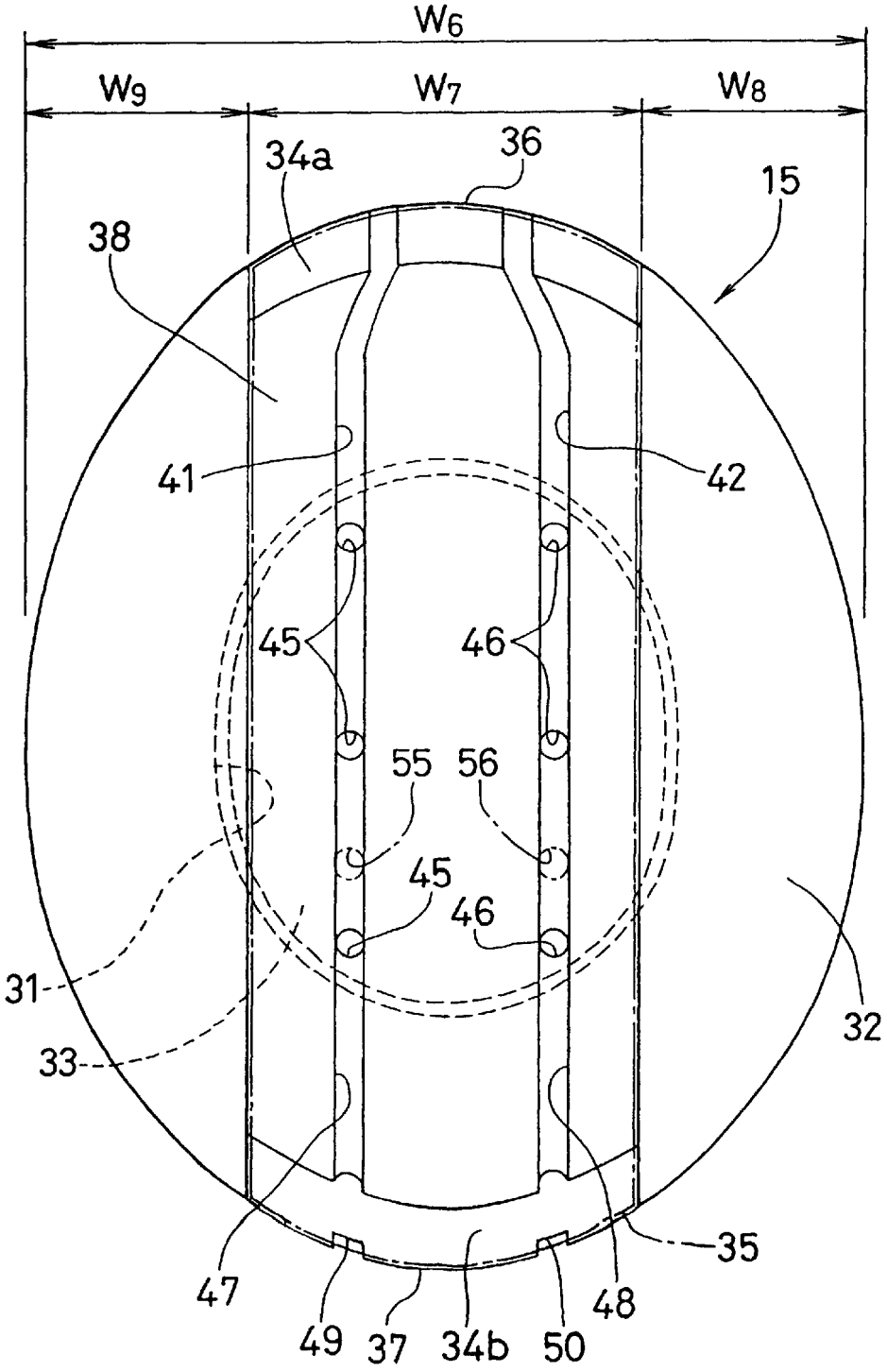
FIG. 6 is a plan view of the impact-on-the-head absorbing liner of FIG. 5, the outer subsidiary liner member being shown in dot-and-dash lines.
Figure 7:
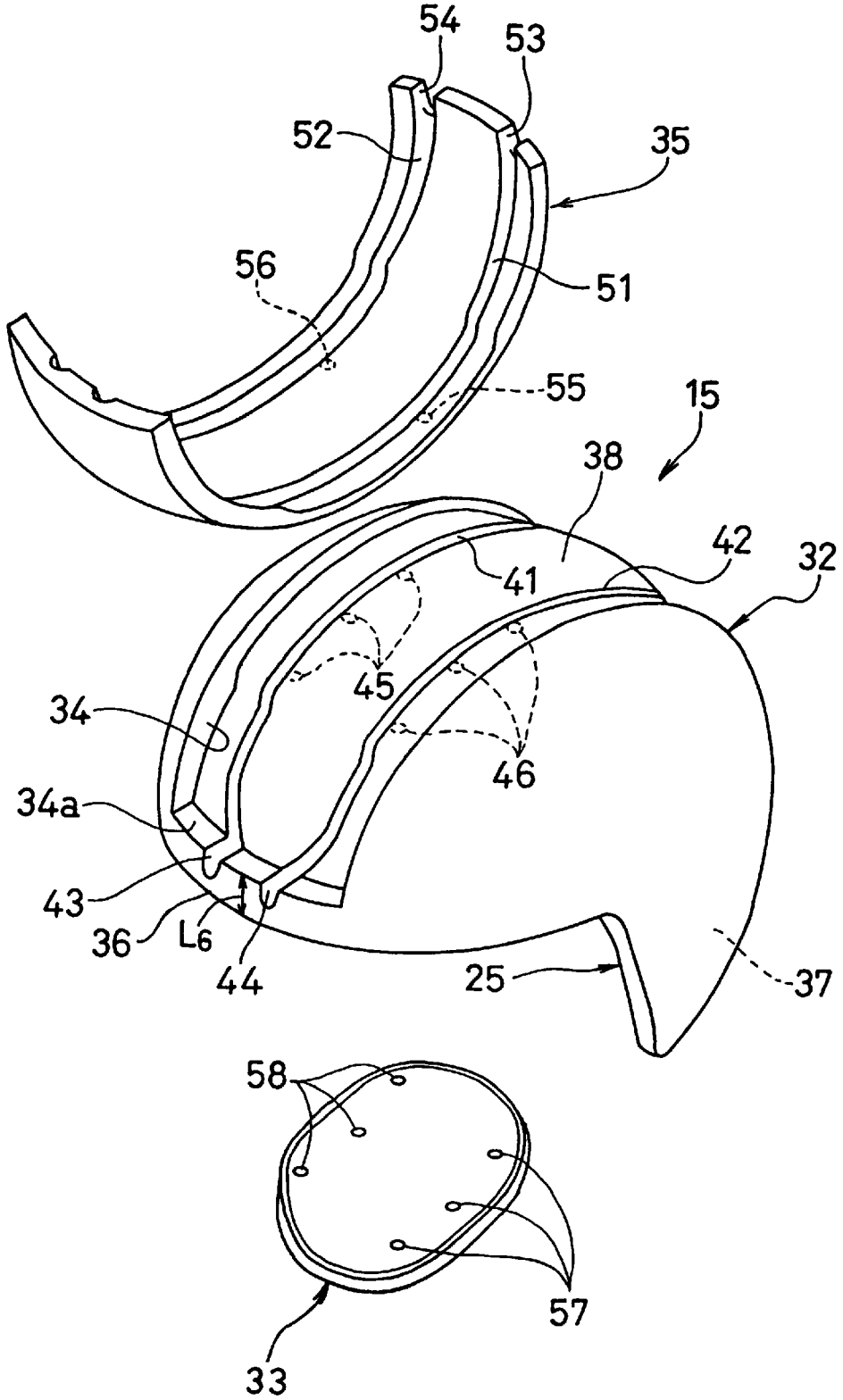
FIG. 7 is an exploded, perspective view of the impact-on-the-head absorbing liner, the inner and outer subsidiary liner members of FIG. 5 each being turned upside down.

In the second embodiment of this invention, an impact-on-the-head absorbing liner 15 shown in FIGS. 5–7 comprises:

(1) main liner member 32 that is different from the well-known one in such points that inner recess 31 is disposed in its inner surface and outer recess 34 is disposed in its outer surface;

(2) inner subsidiary liner member 33 fitted into the inner recess 31 so as to be secured to the main liner member 32; and (3) outer subsidiary liner member 35 fitted into the outer recess 34 so as to be secured to the main liner member 32.

The main liner member 32 disclosed in the second embodiment is similar to the one disclosed in the first embodiment, except that the outer recess 34 and a ventilation mechanism described below are provided. Also the inner subsidiary liner member 33 disclosed in the second embodiment is similar to the one disclosed in the first embodiment, except that a ventilation mechanism described below is provided. Further, also the outer subsidiary liner member 35 disclosed in the second embodiment is formed in such a way as to be similar to the inner subsidiary liner member disclosed in the first embodiment except for the above described and hereinafter described points. In that event, it is preferable that the outer subsidiary liner member 35 is the same in material as the main liner member 32 and the inner subsidiary member 33, but it may be different in material from one or all of them.

In this second embodiment, the object in providing the outer recess 34 and the outer subsidiary member 35 lies in the provision of the ventilation mechanism for the head covering 10 and the improvement of the impact energy dispersing and absorbing ability as it is done in the inner subsidiary liner member 33. For this purpose, the outer recess 34 extending from the front portion to the rear portion via the top portion is provided in the main liner member 32. This outer recess 34 is of substantially spherical shape (but having a spherical surface in part) and, when developed, it is substantially in the shape of a rectangle longer along its longitudinal direction. In addition, its front end 34*a* is located in a position a little above the lower end 36 of the front portion of the main liner member 32, and its rear end 34*b* is located in a position, in a certain degree, above the lower end 37 of the rear portion thereof.

The outer recess 34 is shallow substantially in the top portion (the area substantially opposed to the inner recess 31), and deep in the remaining portion. Further, the depth between the above shallow area and the above deep area becomes gradually deeper toward its front end 34*a* and its rear end 34*b*. In that event, it is preferable that the mean depth difference between the shallow area and the deep area is within 2–18 mm, and it is much preferable that it is within 3–12 mm. As one example, the shallow area may have a depth of 12 mm and the deep area may have a depth of 18 mm.

In the bottom surface 38 of the outer recess 34, a pair of right and left grooves extend from its front end 34*a* to the rear end 34*b* via the top portion, and their front ends are connected to respective notches 43, 44 formed in the front side surface of the outer recess 34. Each groove 41, 42 has a plurality of through holes 45, 46 (there are three holes in the drawing) and, thereby, the grooves 41, 42 are communicated with the inner recess 31. Formed in the main liner member 32 are a pair of right and left grooves 49, 50 upwardly extending between the rear end 34*b* of the outer recess 34 and the lower end 37 of the rear portion.

The outer subsidiary liner member 35, which is substantially the same in shape as the outer recess 34 (that is, a substantially spherical shape and, when developed, substantially a rectangle longer in its longitudinal direction), is fitted into the recess 34 and secured to the main liner member 32 by the help of an adhesive, a tape or the like. In the inner surface of the outer subsidiary liner member 35, a pair of right and left grooves 51, 52, which face the respective grooves 41, 42 of the main liner member 32, extend throughout its length in the longitudinal direction, so that formed between the main liner member 32 and the outer subsidiary liner member 35 are a pair of right and left vent holes 47, which are formed with the grooves 41, 42, 51, 52. These vent holes 47 may be formed only with the grooves 41, 42 of the main liner member 32 or only with the grooves 51, 52 of the outer subsidiary liner member 35.

The rear ends of the grooves 51, 52 are connected to respective notches 53, 54 that pass through the outer subsidiary liner member 35 toward its outer surface. In the drawing, each groove 51, 52 has one through hole 55, 56. Thereby, the grooves 51, 52 are communicated with the outer surface of the outer subsidiary liner member 35 in its top portion via the through hole 55, 56. In the inner subsidiary liner member 33, there are through holes 57, 58 formed two rows (in the drawing there are three holes in each row), and the plurality of through holes 57, 58 in each row are to be faced the plurality of through holes 45, 46, formed two rows, of the main liner member 32, respectively.

As shown in FIG. 5, formed in the outer shell 12 are through holes that are faced the notches 43, 44 of the main liner member 32, and the through holes 55, 56 and notches 53, 54 of the outer subsidiary liner member 35, respectively. Further, secured to these through holes are intake ducts 61 and exhaust ducts 62, 63, respectively. These ducts 61, 62, 63 are located in the front portion, the top portion and the rear portion of the liner 15, respectively, and may be made of suitable material, such as polycarbonate, polyacetal or other synthetic resin.

As shown in FIG. 5, the head covering 10 according to the second embodiment of this invention has, thus, a pair of right and left ventilating passages, each having a route: intake duct 61—notches 43, 44—vent holes 47—notches 53, 54—grooves 49, 50—exhaust duct 63. In addition, these ventilating passages have exhaust bypasses that run from intermediate positions of the vent holes 47 to the exhaust ducts 62 via the through holes 55, 56 of the outer subsidiary liner member 35, and vent passes that make the intermediate positions of the vent holes 47 communicate with the space 21 through the through holes 45, 46 of the main liner member 32 and the through holes 57, 58 of the inner subsidiary liner member 33. Thus, when shutters (not shown) are opened to open the respective ducts 61, 62, 63, fresh air is taken in the head covering 10 via intake duct 61 and this air can be exhausted from the exhaust ducts 62, 63 via vent hole 47. In the ordinary state, the air in the space 21 can be exhausted via through holes 57, 58, 45, 46, vent hole 47, and through holes 55, 56, and, according to the respective open or closed conditions of the shutters for the ducts 61, 62, 63, the air can be taken in the space 21 of the head covering 10 in reverse to the route described above. Therefore, the above ventilation mechanism guarantees a better ventilation of the head covering 10.

In the head covering 10 according to the second embodiment of this invention, the density of the outer subsidiary liner member 35 is determined to be lower than that of the main liner member 32 so as to improve its impact energy dispersing and absorbing ability by the use of the outer subsidiary liner member 35. However, this outer subsidiary liner member 35 is positioned on the outside of the main liner member 32 and lies not only in the top portion but also in the front portion and rear portion of the member 32, so that its density is determined to be higher than that of the inner subsidiary liner member 33.

In this second embodiment, it is preferable that the density of the main liner member 32 is generally within 30–100 g/lit and it is much preferable that it is within 40–90 g/lit. It is preferable that the density of the outer subsidiary liner member 35 is generally within 20–80% of that of the main liner member 32 and it is much preferable that it is within 35–65% thereof. Concretely speaking, it is preferable that the density of the outer subsidiary liner member 35 is within 10–70 g/lit and it is much preferable that it is within 15–60 g/lit. It is preferable that the density of the inner subsidiary liner member 33 is generally within 15–75% of that of the main liner member 32 and it is much preferable that it is within 25–55% thereof. Further, it is preferable that the density of the inner subsidiary liner member 33 is within 35–85% of that of the outer subsidiary liner member 35 and it is much preferable that it is within 45–75% thereof. Concretely speaking, it is preferable that the density of the inner subsidiary liner member 33 is within 5–70% g/lit and it is much preferable that it is within 10–50 g/lit. In a practical instance, the respective densities of the main liner member 32, the outer subsidiary liner member 35 and the inner subsidiary liner member 33 are 60 g/lit, 30 g/lit and 20 g/lit.

It is not always necessary that, when developed, the respective configurations of the outer recess 34 and the outer subsidiary liner member 35 are substantially rectangular. They may be of substantially elliptical or substantially elongated circular shape. For example, particularly, when it is unnecessary to provide the ventilation mechanism within the head covering 10 by means of the outer recess 34 and the outer subsidiary liner member 35, they may be of substantially circular, substantially polygonal, substantially star-like or other suitable shape. Further, it is preferable that the configuration of the outer subsidiary liner member 35 is substantially equal to that of the outer recess 34 or substantially similar to and a little smaller than that of the outer recess 34, but it is not always necessary to be so. For example, when it is unnecessary to provide the ventilation mechanism within the head covering 10 by means of the outer recess 34 and the outer subsidiary liner member 35, the outer recess 34 and the outer subsidiary liner member 35 may be disposed only substantially in the top portion of the liner 15. In that event, it is possible to make the density of the outer subsidiary liner member 35 substantially equal to or smaller than that of the inner subsidiary liner member 33. Further, the length of the outer recess 34, measured along its longitudinal direction, may be within 45–85% of the longitudinal length of the liner 15 like the hereinbefore described ratio of length $L_2$ to length $L_1$, and it is preferable that it is within 50–70% thereof.

FIG. 6 is the projection representation of the plane (the outer subsidiary liner member 35 is indicated in dot-and-dash line) of the impact-on-the-head absorbing liner 15 at the time when the head covering 10 worn in the ordinary stance is projected in the horizontal plane 22.

In the projection representation, it is preferable that the lateral length $W_7$ (the length measured in the horizontal direction in FIG. 6) of the outer recess 34 is within 30–80% of the lateral length $W_6$ of the liner 15 (that is, $W_7/W_6$= 0.3–0.8) and it is much preferable that it is within 40–70% thereof (that is, $W_7/W_6$=0.4–0.7). From the point of practical use, it is preferable that the lateral length $W_6$ of the liner 15 is within 220–280 mm and it is much preferable that it is within 235–265 mm, so that it is preferable that the lateral length $W_7$ of the outer recess 34 is within 90–190 mm and it is much preferable that it is within 110–170 mm. In a practical instance, length $W_6$ is 250 mm and length $W_7$ is 140 mm (that is, $W_7/W_6$=0.56).

In the projection representation shown in FIG. 6, the lateral length of the outer subsidiary liner member 35 is substantially equal to the lateral length $W_7$ of the outer recess 34 but, in general, it is preferable that the lateral length of the member 35 is within 60–100% of length $W_7$ and it much preferable that it is within 75–100% thereof. The longitudinal length of the outer subsidiary liner member 35 (measured in its developed view) is substantially equal to that of the longitudinal length, in the developed view, of the outer recess 34, but, in general, it is preferable that the longitudinal length of the member 35 is within 60–100% thereof and it is much preferable that it is within 75–100% thereof.

The lateral length $W_8$ between the left side end (in FIG. 6, the right side end) of the liner 15 and the left side end of the outer recess 34 may be substantially equal to the lateral length $W_9$ between the right side end of the liner 15 and the right side end of the outer recess 34. Therefore, it is preferable that the respective lengths $W_8$, $W_9$ are within 10–35% of the length $W_6$ and it is much preferable that they are respectively within 15–30% thereof. Concretely speaking, it is preferable that they are respectively within 20–90 mm and it is much preferable that they are respectively within 35–75 mm. In a practical instance, the lengths $W_8$, $W_9$ are 55 mm each (that is, $W_8/W_6=W_9/W_6\approx0.22$).

As a result of the foregoing, in the projection representation shown in FIG. 6, the outer recess 34 is apart in length $W_8$ from the left side end of the liner 15 and apart in length $W_9$ from the right side end thereof, so that the outer recess 34 is formed only in the front portion, the top portion and the rear portion of the outer surface of the liner 15 and not formed in the right and left side portions thereof, so that it does not occur that the formation of the outer recess 34 reduces worthlessly the rigidity (that is, the strength) of the whole of the liner 15.

It is preferable that the distance $L_6$ (FIGS. 5 and 7) between the lower end 36 of the front portion of the liner 15 (in the case of the illustrated jet-type helmet, the upper end of the cut 25 at the center thereof; in the case of the full-face-type helmet, the upper side of the opening at the center thereof) and the front end 34*a* of the outer recess 34 is within 7–50 mm and it is much preferable that it is within 10–40 mm. In a practical instance, the distance $L_6$ is 18 mm. The distance $L_7$ (FIG. 5) between the lower end 37 of the rear portion of the liner 15 and the rear end 34*b* of the outer recess 34 is different in a certain degree, in dependence upon the type of the helmet, such as the illustrated jet-type helmet, the semi-jet-type helmet, or the full-face-type helmet but, in general, it is preferable that the distance $L_7$ is within 7–150 mm and it is much preferable that it is within 10–120 mm. In the jet-type helmet shown in the drawings, it is 60 mm in a practical instance.

It is preferable that the depth of the outer recess 34 (in other words, the distance between the bottom surface 38 of the outer recess 34 and the original outer surface of the liner 15, where the original outer surface shown in the drawings is practically equal to the outer surface of the outer subsidiary liner member 35) is smaller than a half of the original thickness of the liner 15 (that is, the original thickness of the main liner member 32) and larger than 5 mm. It is preferable that the original thickness of the liner 15 is within 15–55 mm as stated before and it is much preferable that it is within 25–45 mm, so that it is preferable that the depth of the outer recess 34 is within 5–30 mm and it is much preferable that it is within 10–20 mm. In a practical instance, the mean depth of the outer recess 34 is 10 mm. It is preferable that the thickness of the main liner member 32 in the portion where the inner recess 31 is formed in its inner surface and the outer recess 34 is formed in its outer surface (that is, the distance between the bottom surface of the inner recess 31 and the bottom surface 38 of the outer recess 34) is within 20–70% of the original thickness of the main liner member 32 and it is much better that it is within 30–60% thereof. Concretely speaking, it it preferable that it is within 5–40 mm and it is much preferable that it is within 8–25 mm. In a practical instance, the thickness of the portion (the portion where the recesses 31, 35 are disposed on the inside portion and the outside portion, respectively) of the main liner member 32 is 7 mm.

It is desirable that the thickness of the outer subsidiary liner member 35 is substantially equal to the depth of the outer recess 34 as shown in the drawings, but skilled in the art without departing from the scope or spirit of the invention as defined in the appended claims.

For example, the safety helmet capable of applying this invention is not limited to the jet-type helmet disclosed in the first and second embodiments, but this invention can be applied to the semi-jet-type helmet, the full-face-type helmet or other types of the helmet.

Moreover, in the first and second embodiments described above, many grooves may be formed in lattice-like arrangement or other suitable arrangement in either or both of the inner surface of the inner subsidiary liner member 33 and the outer surface of the outer subsidiary liner member 35 and, thereby, the impact energy dispersing and absorbing ability of the liner 15 may be further improved.

Moreover, in the first and second embodiments, either or both of the inner recess 31 and the outer recess 34 may be more than one in number and either or both of the inner subsidiary liner member 33 and the outer subsidiary liner member 35 may be correspondingly more than one in number.

Moreover, the inner recess 31 and the outer recess 34 (including the inner subsidiary liner member 33 and the outer subsidiary liner member 35) may be provided in one or more than one of the front portion, the top portion, the rear portion, and the right and left portions of the impact absorbing liner 15. it may be a little smaller or larger than the depth of the outer recess 34. Further, the depth of the outer recess 34 and the thickness of the outer subsidiary liner member 35 shown in the drawings are deep in a certain extent and shallow in a certain extent, but they may be uniform each in whole.

In the second embodiment described above, not only the inner recess 31 and the inner subsidiary liner member 33 are provided on the inside of the main liner member 32, but also the outer recess 34 and the outer subsidiary liner member 35, whose density value lies between the density values of the main liner member 32 and the inner subsidiary liner member 33, are provided on the outside of the main liner member 32. In addition, the ventilation mechanism is incorporated. Therefore, according to the second embodiment, the maximum acceleration exerted on the rider or the like's vertex can be effectively reduced and, also, the duration of the appearances of the acceleration values over a certain value can be reduced to lower the HIC by the same degree or more as disclosed in the first embodiment. Further, the ventilation of the head covering 10 can be improved.

Having described a specific preferred embodiments of the present invention with reference to the accompanying drawings, it is to be understood that the invention is not limited to that precise embodiments, and that various changes and modifications may be effected therein by one

What is claimed is:

1. A head protector for a helmet, comprising an outer hard shell and an absorbing liner inside of the outer shell wherein the liner comprises a main liner member and an inner subsidiary liner member whose density is lower than that of the main liner member, wherein an inner recess is provided in an inner surface of the main liner member, and wherein the inner subsidiary liner member is fitted into the inner recess.

2. A head protector according to claim 1; wherein:

the main liner member and the inner subsidiary liner member are each formed with synthetic resin foam, and the density of the inner subsidiary liner member is within 20–80%, of that of the main liner member.

3. A head protector according to claim 2; wherein:

the density of the main liner member is within 20–80 g/lit, and the density of the inner subsidiary liner member is within 5–50 g/lit.

4. A head protector according to claim 2; wherein:

the density of the main liner member is within 30–70 g/lit, and the density of the inner subsidiary liner member is within 10–40 g/lit.

5. A head protector according to claim 1; wherein:

the depth of the inner recess is smaller than a half of the original thickness of the impact absorbing liner and larger than 5 mm, preferably within 10–20 mm.

6. A head protector according to claim 5; wherein:

the sum of the depth of the inner recess and the thickness of the main liner member in a portion thereof corresponding to the inner recess is within 15–55 mm.

7. A head protector according to claim 5; wherein:

the sum of the depth of the inner recess and the thickness of the main liner member in a portion thereof corresponding to the inner recess is within 25–45 mm.

8. A head protector according to claim 1; wherein:

when the depth of the inner recess is denoted by D, the thickness T of the inner subsidiary liner member is within D–(D+10 mm).

9. A head protector according to claim 1; wherein:

the main liner member and the inner subsidiary liner member are each formed with synthetic resin foam, and the density of the inner subsidiary liner member is within 35–65% of that of the main liner member.

10. A head protector according to claim 1; wherein:

the depth of the inner recess is smaller than a half of the original thickness of the impact absorbing liner and within 10–20 mm.

11. A head protector according to claim 1; wherein:

when the depth of the inner recess is denoted by D, the thickness T of the inner subsidiary liner member is within (D+3 mm)–(D+7 mm).

12. A head protector according to claim 1; wherein:

the inner recess is provided in a predetermined area which includes at least a top portion of an inner surface of the main liner member but does not substantially include at least a front portion thereof.

13. A head protector according to claim 12; wherein:

the predetermined area includes only substantially a top portion of an inner surface of the liner.

14. A head protector according to claim 13; wherein:

a longitudinal length of the predetermined area shown by a bottom view of the head protector is within 40–80% of a longitudinal length of a space, to be occupied by the person's head, of the liner;

a lateral length of the predetermined area shown by a bottom view of the head protector is within 45–85% of a lateral length of the space;

a longitudinal length between a front end of the space and a rear end of the predetermined area, both shown by the bottom view of the head protector, are within 10–30% of the longitudinal length of the space; and a lateral length between a left end of the space and a left end of the predetermined area, and the lateral length between a right end of the space and a right end of the predetermined area, both shown by the bottom view of the head protector, are within 8–28% of the lateral length of the space.

15. A head protector according to claim 14; wherein:

the longitudinal length of the predetermined area shown by a bottom view of the head protector is within 80–200 mm, the lateral length of the predetermined area shown by a bottom view of the head protector is within 70–170 mm.

16. A head protector according to claim 13; wherein:

a longitudinal length of the predetermined area shown by a bottom view of the head protector is within 50–70% of a longitudinal length of a space, to be occupied by the person's head, of the liner;

a lateral length of the predetermined area shown by a bottom view of the head protector is within 55–75% of a lateral length of the space;

a longitudinal length between a front end of the space and a front end of the predetermined area, and a longitudinal length between a rear end of the space and a rear end of the predetermined area, both shown by the bottom view of the head protector, are within 15–25% of the longitudinal length of the space; and a lateral length between a left end of the space and a left end of the predetermined area, and the lateral length between a right end of the space and a right end of the predetermined area, both shown by the bottom view of the head protector, are within 13–22% of the lateral length of the space.

17. A head protector according to claim 14; wherein:

the longitudinal length of the predetermined area shown by a bottom view of the head protector is within 100–160 mm, the lateral length of the predetermined area shown by a bottom view of the head protector is within 90–140 mm.

18. A head protector according to claim 12; wherein:

the inner recess has a substantially elliptical shape extended in a substantially longitudinal direction of the head protector; and the inner recess is inscribed in the predetermined area.

19. A head protector according to claim 18; wherein:

the longitudinal length and the lateral length of the inner subsidiary liner member, both shown by a bottom view of the head protector, are within 60–100% of the longitudinal length and lateral length of the inner recess, respectively.

20. A head protector according to claim 18; wherein:

the longitudinal length and the lateral length of the inner subsidiary liner member, both shown by a bottom view of the head protector, are within 75–100% of the longitudinal length and lateral length of the inner recess, respectively.

21. A head protector according to claim 12; wherein:

the inner recess has a substantially elongated circular extended in a substantially longitudinally direction of the head protector; and the inner recess is inscribed in the predetermined area.

22. A head protector according to claim 12; wherein:

the inner recess has a substantially circular shape; and the inner recess is inscribed in the predetermined area.

23. A head protector according to claim 1; wherein:

the impact absorbing liner further comprises an outer subsidiary liner member, whose density lies between the densities of the main liner member and the inner subsidiary liner member, an outer recess is provided in the outer surface of the main liner member, and the outer subsidiary liner member is fitted into the outer recess.

24. A head protector according to claim 23; wherein:

the outer recess is provided in a second predetermined area, where the front portion, the top portion and the rear portion of the inner surface of the main liner member are included, and the right and left side portions thereof are not substantially included.

25. A head protector according to claim 24; wherein:

the lateral length of the second predetermined area shown by a bottom view of the head protector is within 30–80% of the lateral length of the impact absorbing liner;

the lateral length between the left end of the impact absorbing liner and the left end of the second predetermined area, and the lateral length between the right end of the impact absorbing liner and the right end of the second predetermined area are each within 10–35% of the lateral length of the impact absorbing liner;

the distance between the lower end of the front portion of the impact absorbing liner and the front end of the outer recess is within 7–50 mm; and the distance between the lower end of the rear portion of the impact absorbing liner and the rear end of the outer recess is within 7–150 mm.

26. A head protector according to claim 24; wherein:

the lateral length of the second predetermined area shown by a bottom view of the head protector is within 40–70% of the lateral length of the impact absorbing liner;

the lateral length between the left end of the impact absorbing liner and the left end of the second predetermined area, and the lateral length between the right end of the impact absorbing liner and the right end of the second predetermined area are each within 15–30% of the lateral length of the impact absorbing liner;

the distance between the lower end of the front portion of the impact absorbing liner and the front end of the outer recess is within 10–40 mm; and the distance between the lower end of the rear portion of the impact absorbing liner and the rear end of the outer recess is within 10–120 mm.

27. A head protector according to claim 24; wherein:

the depth of the outer recess is shallow in the area substantially opposed to the inner recess and deep in the remaining area.

28. A head protector according to claim 24; wherein:

when developed, each of the outer recess and the outer subsidiary liner member is of substantially rectangular, substantially elliptical or substantially elongated circular shape, prolonged in the substantially longitudinal direction.

29. A head protector according to claim 28; wherein:

the lateral length of the outer subsidiary liner member shown by a bottom view of the head protector is within 60–100% of the lateral length of the outer recess, and the longitudinal length, when developed, of the outer subsidiary liner member is within 60–100% of the longitudinal length, when developed, of the outer recess.

30. A head protector according to claim 28; wherein:

the lateral length of the outer subsidiary liner member shown by a bottom view of the head protector is within 75–100% of the lateral length of the outer recess and the longitudinal length, when developed, of the outer subsidiary liner member is within 75–100% of the longitudinal length, when developed, of the outer recess.

31. A head protector according to claim 23, wherein:

the main liner member, the inner subsidiary liner member, and the outer subsidiary liner member are each formed with synthetic resin foam, the density of the outer subsidiary liner member is within 35–65% of that of the main liner member, and the density of the inner subsidiary liner member is within 25–55% of that of the main liner member, and is within 45–75% of that of the outer subsidiary liner member.

32. A head protector according to claim 23; wherein:

a mean depth of the outer recess is smaller than a half of an original mean thickness of the impact absorbing liner and larger than 5 mm, 10–20 mm.

33. A head protector according to claim 32; wherein:

the sum of the depth of the inner recess, the depth of the outer recess in a portion thereof corresponding to the inner recess, and the thickness of the main liner member in a portion thereof corresponding to the inner recess and outer recess, respectively, is within 25–45 mm.

34. A head protector according to claim 32; wherein:

the thickness of the portion of the main liner member, where the inner recess and the outer recess are formed in its inner surface and outer surface, respectively, is within 30–60% of the original thickness of the main liner member.

35. A head protector according to claim 32; wherein:

the original thickness of the main liner member at the time when it is assumed that the inner recess and the outer recess are not provided is within 15–55 mm, preferably within 25–45 mm.

36. A head protector according to claim 32; wherein:

the thickness of the portion of the main liner member, where the inner recess and the outer recess are formed in its inner surface and outer surface, respectively, is within 20–70%, of the original thickness of the main liner member.

37. A head protector according to claim 23; wherein:

a mean depth of the outer recess is smaller than a half of an original mean thickness of the impact absorbing liner and within 10–22 mm.

38. A head protector according to claim 23; wherein:

the main liner member, the inner subsidiary liner member, and the outer subsidiary liner member are each formed with synthetic resin foam, the density of the outer subsidiary liner member is within 20–80%, that of the main liner member, and the density of the inner subsidiary liner member is within 15–75%, of that of the main liner member, and is within 35–85%, that of the outer subsidiary liner member.

39. A head protector according to claim 38; wherein:

the density of the main liner member is within 40–90 g/lit, the density of the outer subsidiary liner is within 15–60 g/lit, and the density of the inner subsidiary liner member is within 10–50 g/lit.

40. A head protector according to claim 38; wherein:

the density of the main liner member is within 30–100 g/lit, the density of the outer subsidiary liner member is within 10–70 g/lit, and the density of the inner subsidiary liner member is within 5–70 g/lit.

41. A head protector according to claim 23; wherein:

at least one vent hole is disposed between the main liner member and the outer subsidiary liner member, the vent hole extends from the front portion to the rear portion of the impact absorbing liner via the top portion thereof, and first communicating means for communication between the vent hole and the outer surface of the front portion of the outer shell, and second communicating means for communication between the vent hole and the outer surface of the rear portion of the outer shell are provided.

42. A head protector according to claim 41; wherein:

third communicating means for communication between the vent hole and the outer surface of the top portion of the outer shell, and fourth communicating means for communication between the vent hole and the space of the impact absorbing liner are further provided.

* * * * *

UNITED STATES PATENT AND TRADEMARK OFFICE

CERTIFICATE OF CORRECTION

PATENT NO. : 5,867,840
APPLICATION NO. : 08/739822
DATED : October 30, 1996
INVENTOR(S) : Hirosawa et al.

It is certified that error appears in the above-identified patent and that said Letters Patent is hereby corrected as shown below:

Col. 17, lines 13 - 30; should read;
--14. A head protector according to claim 13; wherein:
a longitudinal length of the predetermined area shown by a bottom view of the head protector is within 40-80% of a longitudinal length of a space, to be occupied by the person's head, of the liner;
a lateral length of the predetermined area shown by a bottom view of the head protector is within 45-85% of a lateral length of the space;
a longitudinal length between a front end of the space and the front end of the predetermined area, and the longitudinal length between the rear end of the space and a rear end of the predetermined area, both shown by the bottom view of the head protector, are within 10-30% of the longitudinal length of the space; and
a lateral length between a left end of the space and a left end of the predetermined area, and the lateral length between a right end of the space and a right end of the predetermined area, both shown by the bottom view of the head protector, are within 8-28% of the lateral length of the space.--

Signed and Sealed this

Fifth Day of February, 2008

JON W. DUDAS
*Director of the United States Patent and Trademark Office*

UNITED STATES PATENT AND TRADEMARK OFFICE

CERTIFICATE OF CORRECTION

PATENT NO. : 5,867,840
APPLICATION NO. : 08/739822
DATED : February 9, 1999
INVENTOR(S) : Hirosawa et al.

It is certified that error appears in the above-identified patent and that said Letters Patent is hereby corrected as shown below:

Col. 17, lines 13 - 30; should read;
--14. A head protector according to claim 13; wherein:
a longitudinal length of the predetermined area shown by a bottom view of the head protector is within 40-80% of a longitudinal length of a space, to be occupied by the person's head, of the liner;
a lateral length of the predetermined area shown by a bottom view of the head protector is within 45-85% of a lateral length of the space;
a longitudinal length between a front end of the space and the front end of the predetermined area, and the longitudinal length between the rear end of the space and a rear end of the predetermined area, both shown by the bottom view of the head protector, are within 10-30% of the longitudinal length of the space; and
a lateral length between a left end of the space and a left end of the predetermined area, and the lateral length between a right end of the space and a right end of the predetermined area, both shown by the bottom view of the head protector, are within 8-28% of the lateral length of the space.--

This certificate supersedes the Certificate of Correction issued February 5, 2008.

Signed and Sealed this

Fourth Day of March, 2008

Jon W. Dudas

JON W. DUDAS
*Director of the United States Patent and Trademark Office*